US011691708B2

(12) United States Patent
Yamada et al.

(10) Patent No.: US 11,691,708 B2
(45) Date of Patent: Jul. 4, 2023

(54) FLUID MACHINE

(71) Applicant: MITSUBISHI HEAVY INDUSTRIES, LTD., Tokyo (JP)

(72) Inventors: Wataru Yamada, Tokyo (JP); Hideyuki Kudo, Tokyo (JP); Shinichi Isobe, Tokyo (JP); Shigeki Senoo, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/825,451

(22) Filed: May 26, 2022

(65) Prior Publication Data

US 2022/0411035 A1 Dec. 29, 2022

(30) Foreign Application Priority Data

Jun. 24, 2021 (JP) ..... 2021-104777

(51) Int. Cl.
*B63H 23/24* (2006.01)
*B63H 1/16* (2006.01)
(Continued)

(52) U.S. Cl.
CPC ..... *B63H 23/24* (2013.01); *B63H 1/16* (2013.01); *F04D 13/086* (2013.01);
(Continued)

(58) Field of Classification Search
CPC . F04D 3/00; F04D 13/06; F04D 13/08; F04D 13/086; F04D 29/5806;
(Continued)

(56) References Cited

U.S. PATENT DOCUMENTS 3,531,214 A * 9/1970 Abramson ..... F04D 3/00 60/221
2013/0115833 A1 5/2013 Suzuki et al.
(Continued)

FOREIGN PATENT DOCUMENTS

CN 114056529 A * 2/2022
JP 2013-100013 5/2013
(Continued)

OTHER PUBLICATIONS

English machine translation of CN114056529A, Oct. 20, 2022.*
English machine translation of KR200477242Y1, Oct. 20, 2022.*

*Primary Examiner* — Christopher Verdier
(74) *Attorney, Agent, or Firm* — Wenderoth, Lind & Ponack, L.L.P.

(57) ABSTRACT

A fluid machine includes: a shaft portion; a shroud surrounding the shaft portion and including an inside surface that forms a flow path-forming surface defining a flow path with the shaft portion; a first propeller rotatably provided in the flow path; a second propeller rotatably provided on a downstream side of the first propeller in the flow path; and a motor including a rotor that is fixed to an outer circumferential portion of the second propeller and that is accommodated in the shroud, and a stator that surrounds the rotor via a clearance and that is fixed in the shroud. A portion of the flow path-forming surface on a downstream side of the second propeller decreases in diameter toward the downstream side, and the shroud includes an inlet flow path that is open at a portion between the first propeller and the second propeller of the flow path-forming surface.

4 Claims, 3 Drawing Sheets

(51) Int. Cl.

| | |
|---|---|
| ***F04D 13/08*** | (2006.01) |
| ***F04D 29/58*** | (2006.01) |
| ***B63H 23/00*** | (2006.01) |
| ***B63H 5/10*** | (2006.01) |
| ***F04D 3/00*** | (2006.01) |
| ***B63H 11/107*** | (2006.01) |
| ***B63H 11/08*** | (2006.01) |
| ***B63H 11/10*** | (2006.01) |

(52) U.S. Cl.
CPC ..... *F04D 29/5806* (2013.01); *F04D 29/588* (2013.01); *F04D 29/5886* (2013.01); *B63H 5/10* (2013.01); *B63H 11/08* (2013.01); *B63H 11/101* (2013.01); *B63H 11/107* (2013.01); *B63H 2001/165* (2013.01); *B63H 2005/106* (2013.01); *B63H 2023/005* (2013.01); *F04D 3/00* (2013.01)

(58) Field of Classification Search
CPC .. F04D 29/586; F04D 29/588; F04D 29/5886; B63H 1/16; B63H 2001/165; B63H 5/10; B63H 2005/106; B63H 11/08; B63H 11/107; B63H 23/24; B63H 11/101
See application file for complete search history.

(56) References Cited

U.S. PATENT DOCUMENTS

| | | | | |
|---|---|---|---|---|
| 2022/0315181 | A1* | 10/2022 | Senoo | B63H 1/16 |
| 2022/0315183 | A1* | 10/2022 | Senoo | B63H 21/17 |
| 2022/0315184 | A1* | 10/2022 | Senoo | B63G 8/08 |
| 2022/0315185 | A1* | 10/2022 | Senoo | H02K 5/132 |

FOREIGN PATENT DOCUMENTS

| | | | | |
|---|---|---|---|---|
| KR | 20047742 | Y1 * | 5/2021 | |
| WO | WO-2004113717 | A1 * | 12/2004 | B63H 11/08 |

* cited by examiner

FLUID MACHINE

CROSS-REFERENCE TO RELATED APPLICATIONS

This application claims the benefit of priority to Japanese Patent Application Number 2021-104777 filed on Jun. 24, 2021. The entire contents of the above-identified application are hereby incorporated by reference.

TECHNICAL FIELD

The disclosure relates to a fluid machine.

RELATED ART

For example, an outer circumference driven marine propulsor is disclosed in JP 2013-100013 A as an example of a fluid machine. The above-described marine propulsor includes a propulsion unit including a duct having a cylindrical shape centered on an axis, contra-rotating propellers coaxially held in two stages on the inner side of this duct, and a motor that rotates these contra-rotating propellers.

The duct accommodates two motors corresponding to the two-stage propellers, respectively. These motors each include a rotor provided in an outer circumferential portion of the propeller and a stator surrounding the rotor from the outer circumference side. The motor and the stator each have a cylindrical shape where an outer surface and an inner surface thereof are parallel to the axis. The two motors are juxtaposed at the same radial position in the axis direction. The two propellers are outer circumference driven by these motors, so the fluid in the duct is pumped in the axis direction, and the marine propulsor can obtain the propulsion force.

SUMMARY

Incidentally, in the propulsion unit described in JP 2013-100013 A described above, heat is generated as the rotors rotate, so it is necessary to cool the motors in order to protect the motors from heat. Difference in static pressure always occurs between the flow path on the downstream side of the front stage-side propeller and the flow path on the upstream side thereof. For that reason, the fluid always flows from the space on the downstream side of the front stage-side propeller toward the space on the upstream side thereof, through the flow path defined by the rotor of the front stage-side motor and the duct, and the clearance defined by the rotor and stator of the front stage-side motor. As a result, the front stage-side motor can always exchange heat with the fluid.

On the other hand, in the rear stage-side motor, depending on the position of the opening of the flow path defined by the rotor of the rear stage-side motor and the duct, there is a possibility that the magnitudes of the static pressure of the flow path on the upstream side and the flow path on the downstream side that sandwich the rear stage-side propeller reverse. This makes it difficult to grasp the direction in which the fluid flows. For this reason, there is a possibility that the motor that rotationally drives the rear stage-side propeller cannot be stably cooled.

The disclosure has been made to solve the above-described problems. An object of the disclosure is to provide a fluid machine capable of stably cooling the motor that rotationally drives the rear stage-side propeller.

In order to solve the above-described problems, the fluid machine according to the disclosure includes: a shaft portion extending in an axis direction; a shroud provided so as to surround the shaft portion and including a shroud inside surface that forms a flow path-forming surface defining a flow path through which fluid is flowable in the axis direction with the shaft portion; a first propeller rotatably provided around the axis in the flow path; a second propeller rotatably provided around the axis on a downstream side of the first propeller in the flow path; and a motor including a rotor that has a ring shape fixed to an outer circumferential portion of the second propeller and that is accommodated in the shroud and a stator that has a ring shape surrounding the rotor via a clearance and that is fixed in the shroud, wherein at least a portion of the flow path-forming surface on a downstream side of the second propeller has a diameter that decreases toward the downstream side, and the shroud includes an inlet flow path that is open at a portion between the first propeller and the second propeller in the flow path-forming surface and that brings the flow path and the clearance into communication with each other and an outlet flow path that is open at a portion on the downstream side of and separated from the second propeller in the flow path-forming surface and that brings the flow path and the clearance into communication with each other.

According to the disclosure, it is possible to provide a fluid machine capable of stably cooling the motor that rotationally drives the rear stage-side propeller.

BRIEF DESCRIPTION OF DRAWINGS

The disclosure will be described with reference to the accompanying drawings, wherein like numbers reference like elements.

DESCRIPTION OF EMBODIMENTS

Underwater Vehicle

Figure 1:
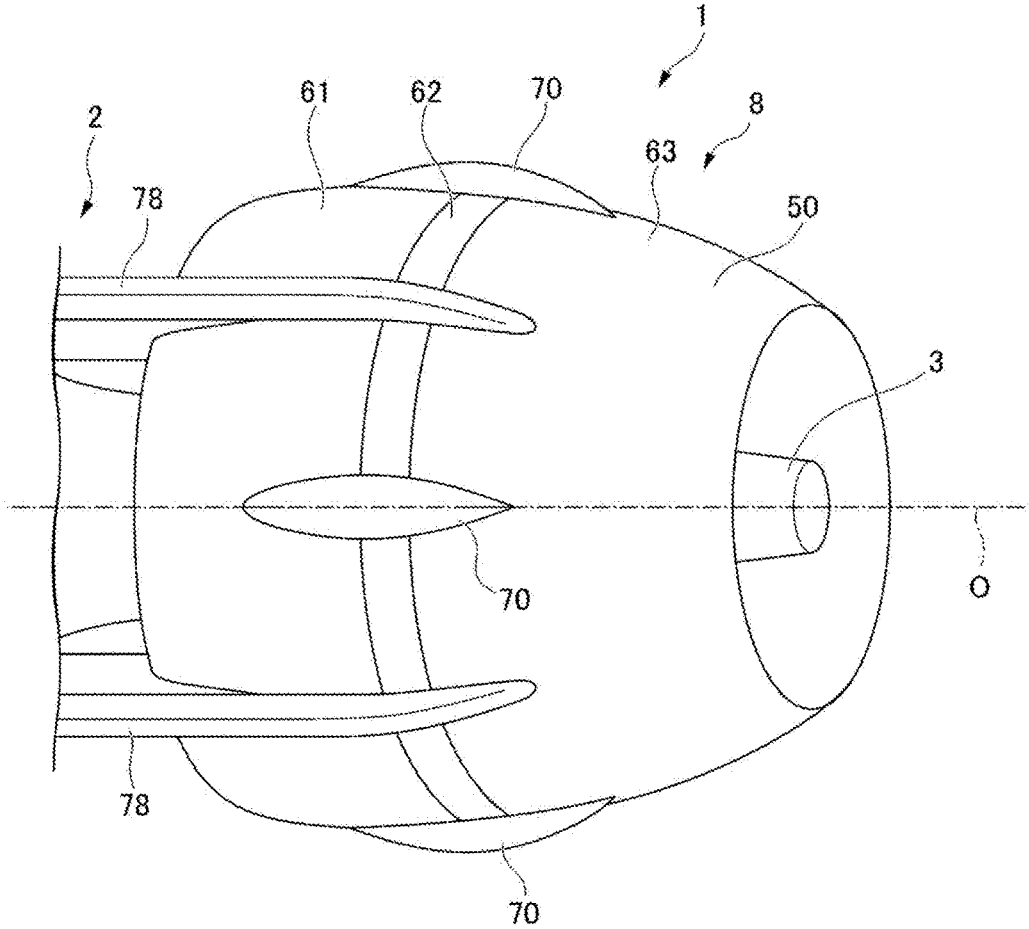
FIG. 1 is a perspective view of a stern of an underwater vehicle according to an embodiment of the disclosure.
Figure 2:
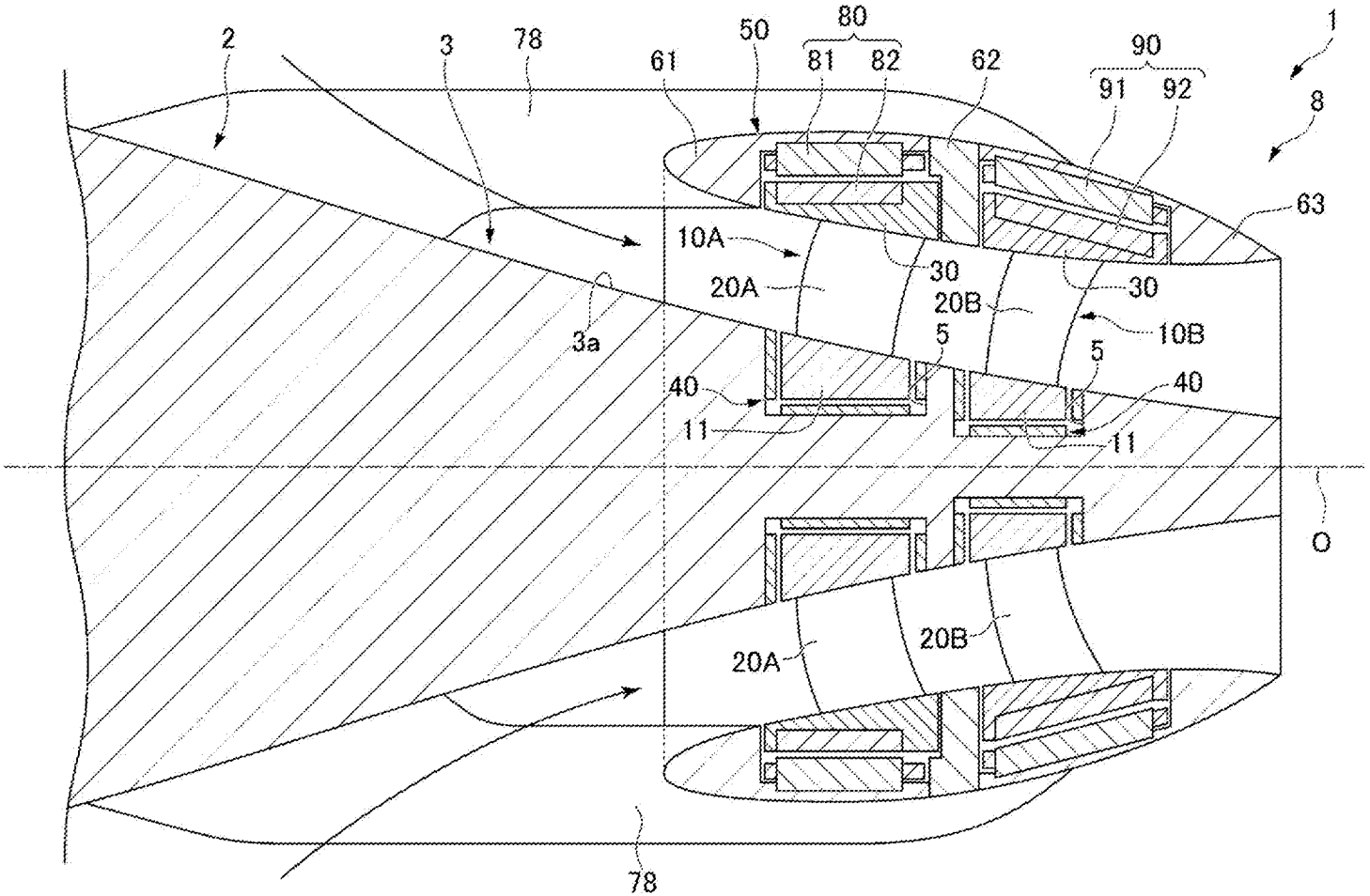
FIG. 2 is a vertical cross-sectional view of a propulsor according to an embodiment of the disclosure.

Hereinafter, embodiments of the disclosure will be described in detail with reference to the drawings. As illustrated in FIGS. 1 and 2, an underwater vehicle 1 includes a vehicle main body 2 and a propulsor (fluid machine) 8.

Vehicle Main Body

The vehicle main body 2 is composed of a pressure-resistant container that extends along an axis O. The vehicle main body 2 accommodates various instruments, power supplies, communication equipment, sensors, and the like required for cruising underwater, for example.

Propulsor

In a rear portion of the vehicle main body 2, the propulsor 8 is provided integrally with the vehicle main body 2. The propulsor 8 is a device for propelling the underwater vehicle 1 underwater.

The propulsor 8 includes a shaft portion 3, a first propeller 10A, a second propeller 10B, bearing portions 40, a shroud 50, coupling portions 70, struts 78, a cylindrical motor 80, and a conical motor (motor) 90.

Shaft Portion

As illustrated in FIG. 2, the shaft portion 3 is integrally provided in the rear portion of the vehicle main body 2. The shaft portion 3 may be part of the vehicle main body 2. The shaft portion 3 has a rod shape extending in the axis O direction. The shaft portion 3 of the present embodiment has a truncated cone shape having a diameter that decreases from one side in the axis O direction (front side of the vehicle main body 2) toward the other side in the axis O direction (rear side of the vehicle main body 2). The surface facing radially outward of the shaft portion 3 is a shaft outside surface 3*a* having a tapered shape that decreases in diameter toward the other side in the axis O direction.

In the shaft portion 3, receiving grooves 5 that are recessed radially inward from the shaft outside surface 3*a* and that annularly extend in a circumferential direction are formed. Two receiving grooves 5 in the present embodiment are formed spaced apart in the axis O direction.

Figure 3:
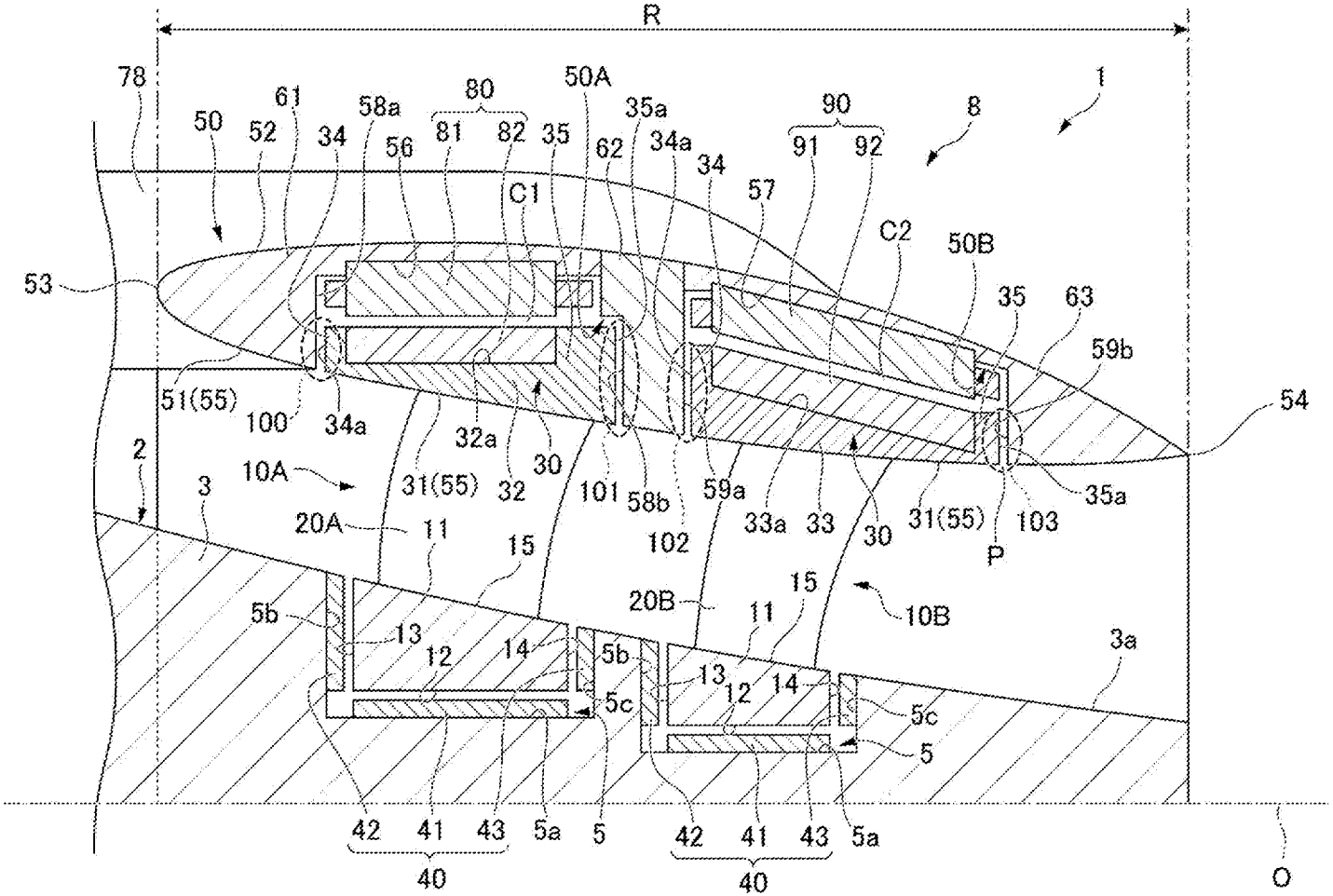
FIG. 3 is an enlarged view of a main part in FIG. 2.

As illustrated in FIG. 3 in detail, the surface facing radially outward that serves as the bottom of each receiving groove 5 is a groove bottom surface 5*a*. The groove bottom surface 5*a* has a cylindrical shape around the axis O.

The surface on the one side in the axis O direction that constitutes the receiving groove 5 is a groove upstream surface 5*b*. The groove upstream surface 5*b* has a planar shape orthogonal to the axis O, and faces the other side in the axis O direction. The groove upstream surface 5*b* annularly extends around the axis O.

The surface on the other side in the axis O direction that constitutes the receiving groove 5 is a groove downstream surface 5*c*. The groove downstream surface 5*c* has a planar shape orthogonal to the axis O, and faces the one side in the axis O direction. The groove downstream surface 5*c* annularly extends around the axis O. The groove downstream surface 5*c* is parallel to the groove upstream surface 5*b*.

First Propeller and Second Propeller

As illustrated in FIGS. 2 and 3, the first propeller 10A and the second propeller 10B are disposed on an outer circumference side of the shaft portion 3, and are relatively rotatable around the axis O relative to the shaft portion 3. The first propeller 10A includes an inner circumferential ring 11, first blades 20A, and an outer circumferential ring 30. The second propeller 10B includes an inner circumferential ring 11, second blades (blades) 20B, and an outer circumferential ring 30.

Inner Circumferential Ring

The inner circumferential ring 11 is a member having a ring shape around the axis O. The inner circumferential ring 11 of the first propeller 10A is received in the receiving groove 5 on the one side in the axis O direction. The inner circumferential ring 11 of the second propeller 10B is received in the receiving groove 5 on the other side in the axis O direction.

As illustrated in FIG. 3, the inner circumferential ring 11 includes a ring inner surface 12, an upstream end surface 13, a downstream end surface 14, and an outer circumferential flow path surface 15.

The ring inner surface 12 constitutes an inside surface of the inner circumferential ring 11. The ring inner surface 12 has a cylindrical shape facing the groove bottom surface 5*a* over the circumferential direction. The inside diameter of the ring inner surface 12 is set to be greater than the outside diameter of the groove bottom surface 5*a*.

The upstream end surface 13 is a surface facing the one side in the axis O direction in the inner circumferential ring 11, and is disposed on the other side in the axis O direction of the groove upstream surface 5*b* with a space in between.

The downstream end surface 14 is a surface facing the other side in the axis O direction in the inner circumferential ring 11, and is disposed on the one side in the axis O direction of the groove downstream surface 5*c* with a space in between.

The outer circumferential flow path surface 15 constitutes an outside surface facing radially outward in the inner circumferential ring 11. The outer circumferential flow path surface 15 has a tapered shape having a diameter that decreases toward the other side in the axis O direction. The outer circumferential flow path surface 15 extends so as to be continuous with the shaft outside surface 3*a*.

First Blades and Second Blades

The first blades 20A are provided so as to extend radially outward from the outer circumferential flow path surface 15 in the inner circumferential ring 11 of the first propeller 10A. The second blades 20B extend radially outward from the outer circumferential flow path surface 15 in the inner circumferential ring 11 of the second propeller 10B. The first blades 20A and the second blades 20B are provided in plurality in the inner circumferential rings 11 spaced apart in the circumferential direction. The dimension of the first blades 20A and the second blades 20B in the axis O direction, also known as the chord length, is smaller than the dimension of the inner circumferential ring 11 in the axis O direction.

The first blades 20A and the second blades 20B have blade-shaped cross-sections intersecting in the radial direction. Edge portions of the first blades 20A and the second blades 20B on the one side in the axis O direction are leading edges on an upstream side. Edge portions of the first blades 20A and the second blades 20B on the other side in the axis O direction are trailing edges on a downstream side. Hereinafter, the one side in the axis O direction will be simply referred to as the "upstream side," and the other side in the axis O direction will be simply referred to as the "downstream side."

Outer Circumferential Ring

As illustrated in FIGS. 2 and 3, the outer circumferential rings 30 are members constituting outer circumferential portions of the first propeller 10A and the second propeller 10B, respectively, and have ring shapes around the axis O. The outer circumferential ring 30 of the first propeller 10A connects a plurality of the first blades 20A, which are arranged in the circumferential direction, in the circumferential direction. The outer circumferential ring 30 of the second propeller 10B connects a plurality of the second blades 20B, which are arranged in the circumferential direction, in the circumferential direction. The dimension of the outer circumferential ring 30 of the first propeller 10A in the axis O direction is larger than the dimension of the first blades 20A in the axis O direction. The dimension of the outer circumferential ring 30 of the second propeller 10B in the axis O direction is larger than the dimension of the second blades 20B in the axis O direction.

The outer circumferential ring 30 of the first propeller 10A includes a first base portion 32, a first holding portion 34, and a second holding portion 35.

The outer circumferential ring 30 of the second propeller 10B includes a second base portion 33, a first holding portion 34, and a second holding portion 35.

The first base portion 32 is a member corresponding to the main body portion of the outer circumferential ring 30 in the first propeller 10A, and has a cylindrical shape around the axis O. The first base portion 32 includes a ring inside surface 31 and a cylindrical fixing surface 32*a*. The ring inside surface 31 is a surface constituting the inside surface of the first base portion 32. The ring inside surface 31 of the first base portion 32 is integrally connected to end portions on the radially outer side of the plurality of first blades 20A arranged in the circumferential direction. The cylindrical fixing surface 32*a* is a surface constituting the outside surface in the first base portion 32. The cylindrical fixing surface 32*a* has a cylindrical shape around the axis O, and extends in the axis O direction. The cylindrical fixing surface 32*a* is parallel to the axis O.

The second base portion 33 is a member corresponding to the main body portion of the outer circumferential ring 30 in the second propeller 10B, and has a cylindrical shape around the axis O. The second base portion 33 includes a ring inside surface 31 and a tapered fixing surface 33*a*. The ring inside surface 31 is a surface constituting the inside surface of the second base portion 33. The ring inside surface 31 of the second base portion 33 is integrally connected to end portions on the radially outer side of the plurality of second blades 20B arranged in the circumferential direction. The tapered fixing surface 33*a* is a surface constituting the outside surface in the outer circumferential ring 30 of the second propeller 10B. The tapered fixing surface 33*a* has a tapered shape having a diameter that decreases toward the downstream side. The tapered fixing surface 33*a* extends in the axis O direction with a uniform taper angle, that is, with a uniform inclination angle relative to the axis O. With such a tapered fixing surface 33*a* provided, the thickness of the outer circumferential ring 30 of the second propeller 10B in the radial direction decreases toward the downstream side.

Here, the average outside diameter of the tapered fixing surface 33*a* is set to be smaller than the average outside diameter of the cylindrical fixing surface 32*a*. In the present embodiment, the tapered fixing surface 33*a* extends in a uniform tapered shape in the axis O direction. For that reason, the average outside diameter of the tapered fixing surface 33*a* is the same as the outside diameter of the tapered fixing surface 33*a* at the center in the axis O direction. Furthermore, the average outside diameter of the cylindrical fixing surface 32*a* is the same as the outside diameter of any portion of the cylindrical fixing surface 32*a* in the axis O direction.

In the present embodiment, the outside diameter of the end portion on the upstream side of the tapered fixing surface 33*a* is set to be the same as the outside diameter of the end portion on the downstream side of the cylindrical fixing surface 32*a*, or smaller than the outside diameter of the end portion on the downstream side of the cylindrical fixing surface 32*a*.

The first holding portions 34 protrude radially outward from the end portion on the upstream side of the cylindrical fixing surface 32*a* of the first base portion 32 and the end portion on the upstream side of the tapered fixing surface 33*a* of the second base portion 33, respectively, and extend over the circumferential direction. The surface facing the one side in the axis O direction of the first holding portion 34 is an outer circumferential ring upstream surface 34*a*, which is an end surface on the upstream side of the outer circumferential ring 30.

The second holding portions 35 protrude radially outward from the end portion on the downstream side of the cylindrical fixing surface 32*a* of the first base portion 32 and the end portion on the downstream side of the tapered fixing surface 33*a* of the second base portion 33, respectively, and extend over the circumferential direction. The surface facing the other side in the axis O direction of the second holding portion 35 is an outer circumferential ring downstream surface 35*a*, which is an end surface on the downstream side of the outer circumferential ring 30.

Bearing Portions

The bearing portions 40 rotatably support the first propeller 10A and the second propeller 10B around the axis O relative to the shaft portion 3. The bearing portions 40 are provided in the respective receiving grooves 5 and rotatably supports the inner circumferential rings 11 of the first propeller 10A and the second propeller 10B. The bearing portions 40 each include a radial bearing 41, an upstream thrust bearing 42, and a downstream thrust bearing 43.

The radial bearing 41 is provided on the groove bottom surface 5*a* of the receiving groove 5 over the circumferential direction. In the present embodiment, a journal bearing is employed as the radial bearing 41. The outside diameter of the radial bearing 41 is smaller than the inside diameter of the inner circumferential ring 11. As a result, a clearance is formed between the radial bearing 41 and the inner circumferential ring 11 over the circumferential direction.

The upstream thrust bearing 42 is provided on the groove upstream surface 5*b* of the receiving groove 5 over the circumferential direction. The upstream thrust bearing 42 faces the upstream end surface 13 of the inner circumferential ring 11 in the axis O direction across the clearance.

The downstream thrust bearing 43 is provided on the groove downstream surface 5*c* of the receiving groove 5 over the circumferential direction. The downstream thrust bearing 43 faces the downstream end surface 14 of the inner circumferential ring 11 in the axis O direction across the clearance.

Water flowing into the receiving groove 5 is interposed between the radial bearing 41, the upstream thrust bearing 42, the downstream thrust bearing 43, and the inner circumferential ring 11. Accordingly, the radial bearing 41, the upstream thrust bearing 42, and the downstream thrust bearing 43 rotatably support the inner circumferential ring 11 via a water film formed between these bearings and the inner circumferential ring 11.

Shroud

The shroud 50 is provided so as to surround the shaft portion 3, the first propeller 10A, and the second propeller 10B from the outer circumference side. The shroud 50 has an annular shape around the axis O. The shroud 50 is disposed spaced apart from the outside surface of the shaft portion 3 in the radial direction. Accordingly, between the shroud 50 and the shaft portion 3, a flow path is formed that has an annular shape over the axis O direction and through which the fluid can flow in the axis O direction.

The shroud 50 includes a shroud inside surface 51 and a shroud outside surface 52. The shroud inside surface 51 is a surface facing radially inward, and defines a flow path through which the fluid can flow in the axis O direction with the shaft portion 3. The shroud outside surface 52 is a surface facing radially outward in the shroud 50.

In the flow path, the first blades 20A of the first propeller 10A and the second blades 20B of the second propeller 10B extending radially are disposed. The outer circumferential rings 30 of the first propeller 10A and the second propeller 10B are accommodated in the shroud 50. Therefore, the first propeller 10A is rotatably provided around the axis O in the flow path, and the second propeller 10B is rotatably provided around the axis O on the downstream side of the first propeller 10A in the flow path.

The shroud 50 in the present embodiment including the axis O has a blade-shaped cross-section. The connection point between end portions of the shroud inside surface 51 and the shroud outside surface 52 on the upstream side is a shroud leading edge 53 having an annular shape over the circumferential direction. The connection point between end portions of the shroud inside surface 51 and the shroud outside surface 52 on the downstream side is a shroud trailing edge 54 having an annular shape over the circumferential direction. The position in the axis O direction of the shroud trailing edge 54 is the same as the position in the axis O direction of the rear end on the other side in the axis O direction of the shaft portion 3.

The shroud 50 has a shape having a diameter that gradually decreases from the upstream side toward the downstream side. In the present embodiment, in the blade-shaped cross-section of the shroud 50, a blade center line (camber line), of which the distances from the shroud inside surface 51 and the shroud outside surface 52 are equal to each other, is gradually inclined radially inward from the upstream side toward the downstream side. As a result, the shroud trailing edge 54 is located on the radially inner side of the shroud leading edge 53.

The shroud outside surface 52 first increases in diameter near the shroud leading edge 53 toward the downstream side, and then smoothly decreases in diameter farther toward the downstream side. The shroud outside surface 52 has a convex curved shape protruding radially outward.

A first cavity 50A and a second cavity (cavity) 50B recessed radially outward from the shroud inside surface 51 are formed in the shroud 50. The first cavity 50A is formed at a portion nearer to the upstream side in the shroud 50, whereas the second cavity 50B is formed at a portion nearer to the downstream side in the shroud 50. That is, the second cavity SOB is formed on the downstream side of the first cavity 50A.

The outer circumferential ring 30 of the first propeller 10A is accommodated in the first cavity 50A. The outer circumferential ring 30 of the second propeller 10B is accommodated in the second cavity 50B.

On the surface facing radially inward in the first cavity 50A, a cylindrical fixing recess portion 56 that has a bottom portion and that has a cylindrical shape around the axis O is formed. The cylindrical fixing recess portion 56 is formed at a position in the axis O direction corresponding to the cylindrical fixing surface 32*a* of the first base portion 32 in the outer circumferential ring 30 of the first propeller 10A.

On the surface facing radially inward in the second cavity 50B, a tapered fixing recess portion 57 including a bottom portion having a diameter that decreases toward the downstream side with a uniform taper angle is formed. The tapered fixing recess portion 57 is formed at a position in the axis O direction corresponding to the tapered fixing surface 33*a* of the second base portion 33 in the outer circumferential ring 30 of the second propeller 10B.

The ring inside surfaces 31 of the first base portion 32 and the second base portion 33 in the respective outer circumferential rings 30 extend so as to be continuous with the shroud inside surface 51 in the axis O direction. That is, the ring inside surface 31 extends so as to constitute part of the convex curved surface of the shroud inside surface 51. Together with the shroud inside surface 51, the ring inside surface 31 in the present embodiment forms a flow path-forming surface 55 that is uniformly continuous from the shroud leading edge 53 to the shroud trailing edge 54.

At a middle position nearer to the shroud trailing edge 54 in the flow path-forming surface 55 from the shroud leading edge 53 toward the shroud trailing edge 54, there is a position at which the radial distance from the axis O is minimized, that is, the inside diameter of the flow path-forming surface 55 is minimized in the flow path-forming surface 55. In the present embodiment, this position in the flow path-forming surface 55 at which the inside diameter of the flow path-forming surface 55 is minimized is referred to as a minimum inside diameter position P.

The flow path-forming surface 55 smoothly increases in diameter from the minimum inside diameter position P toward the shroud trailing edge 54. Therefore, the flow path-forming surface 55 has a convex curved shape protruding radially inward. Note that the flow path-forming surface 55 need not increase in diameter from the minimum inside diameter position P toward the shroud trailing edge 54. The flow path-forming surface 55 may extend parallel to the axis O from the minimum inside diameter position P toward the shroud trailing edge 54.

The annular flow path formed between the flow path-forming surface 55 and the shaft outside surface 3*a* of the shaft portion 3 is narrowed radially inward from the shroud leading edge 53 toward the minimum inside diameter position P. Accordingly, the cross-sectional area of the flow path gradually decreases from the position of the shroud leading edge 53 toward the downstream side, and is minimized at the minimum inside diameter position P.

The minimum inside diameter position P is located on the downstream side of and separated from the trailing edge of the second blades 20B of the second propeller 10B. It is desirable that the minimum inside diameter position P be separated by a distance greater than or equal to half of the chord length (chord length) of the second blades 20B, from the connection position between the trailing edge of the second blades 20B and the ring inside surface 31 of the second base portion 33 in the outer circumferential ring 30.

The surface on the one side in the axis O direction that constitutes the inner surface of the first cavity 50A is a first cavity upstream surface 58*a*. The first cavity upstream surface 58*a* has a planar shape orthogonal to the axis O, and faces the other side in the axis O direction. The first cavity upstream surface 58*a* annularly extends around the axis O.

The surface on the other side in the axis O direction that constitutes the inner surface of the first cavity 50A is a first cavity downstream surface 58*b*. The first cavity downstream surface 58*b* has a planar shape orthogonal to the axis O, and faces the one side in the axis O direction. The first cavity downstream surface 58*b* annularly extends around the axis O. The first cavity downstream surface 58*b* is parallel to the first cavity upstream surface 58*a*.

The shroud 50 includes a first outlet flow path 100 defined and formed in the circumferential direction by the outer circumferential ring upstream surface 34*a* in the outer circumferential ring 30 of the first propeller 10A and the first cavity upstream surface 58*a*. The first outlet flow path 100 is open at a portion on the one side in the axis O direction of the first propeller 10A in the flow path-forming surface 55.

The shroud 50 includes a first inlet flow path 101 defined and formed in the circumferential direction by the outer circumferential ring downstream surface 35*a* in the outer circumferential ring 30 of the first propeller 10A and the first cavity downstream surface 58*b*. The first inlet flow path 101 is open at a portion between the first propeller 10A and the second propeller 10B in the flow path-forming surface 55.

The surface on the one side in the axis O direction that constitutes the inner surface of the second cavity SOB is a second cavity upstream surface 59*a*. The second cavity upstream surface 59*a* has a planar shape orthogonal to the axis O, and faces the other side in the axis O direction. The second cavity upstream surface 59*a* annularly extends around the axis O.

The surface on the other side in the axis O direction that constitutes the inner surface of the second cavity 50B is a second cavity downstream surface 59*b*. The second cavity downstream surface 59*b* has a planar shape orthogonal to the axis O, and faces the one side in the axis O direction. The second cavity downstream surface 59*b* annularly extends around the axis O. The second cavity downstream surface 59*b* is parallel to the second cavity upstream surface 59*a*.

The shroud 50 includes a second inlet flow path (inlet flow path) 102 defined and formed in the circumferential direction by the outer circumferential ring upstream surface 34*a* in the outer circumferential ring 30 of the second propeller 10B and the second cavity upstream surface 59*a*. The second inlet flow path 102 is open at a portion between the first propeller 10A and the second propeller 10B in the flow path-forming surface 55.

The shroud 50 includes a second outlet flow path (outlet flow path) 103 defined and formed in the circumferential direction by the outer circumferential ring downstream surface 35*a* in the outer circumferential ring 30 of the second propeller 10B and the second cavity downstream surface 59*b*. The second outlet flow path 103 is open at a portion on the downstream side of and separated from the second propeller 10B in the flow path-forming surface 55.

Specifically, the second outlet flow path 103 is open in the vicinity of the minimum inside diameter position P at which the inside diameter of the flow path-forming surface 55 is minimized in the flow path-forming surface 55. It is desirable that the vicinity of the minimum inside diameter position P in the present embodiment be a region falling within the range of ±10% of a dimension R of the shroud in the axis direction, based on this minimum inside diameter position P.

Here, the shroud 50 in the present embodiment is composed of coupling a plurality of segments split in the axis O direction. That is, as the segments, the shroud 50 is constituted by an upstream segment 61, an intermediate segment 62, and a downstream segment 63.

The upstream segment 61 constitutes a portion on the upstream side including the shroud leading edge 53. The intermediate segment 62 constitutes a portion that is continuous with the downstream side of the upstream segment 61 in the shroud 50. The first cavity 50A is defined and formed by the intermediate segment 62 closing, from the downstream side, a large notched part on the radially inner side and on the downstream side in the upstream segment 61. The downstream segment 63 constitutes a portion that is continuous with the downstream side of the intermediate segment 62, and that includes the shroud trailing edge 54. The second cavity 50B is defined and formed by the intermediate segment 62 closing, from the upstream side, a large notched part on the radially inner side and on the upstream side in the downstream segment 63.

Coupling Portions

As illustrated in FIG. 1, the coupling portions 70 are provided so as to protrude from the shroud outside surface 52 in the shroud 50. The coupling portions 70 couple the plurality of segments of the shroud 50 to each other.

Struts

As illustrated in FIGS. 1 and 2, the struts 78 couple the shroud 50 and the shaft portion 3 to each other, thereby supporting the shroud 50 relative to the shaft portion 3. The struts 78 are provided in plurality spaced apart in the circumferential direction, and extend in the axis O direction. The end portion on the downstream side in each strut 78 is fixed to the shroud 50. The end portion on the upstream side of each strut 78 is fixed to the shaft outside surface 3*a* of the shaft portion 3.

The cross-sectional shape of the struts 78 orthogonal to the axis O is a flat rectangular shape in which the radial direction is the longitudinal direction and the circumferential direction is the shorter direction. Accordingly, rotation in the propulsion of the underwater vehicle 1 is suppressed.

Cylindrical Motor

As illustrated in FIGS. 2 and 3, the cylindrical motor 80 is accommodated in the first cavity 50A in the shroud 50. The cylindrical motor 80 rotationally drives the first propeller 10A. The cylindrical motor 80 includes a cylindrical stator 81 and a cylindrical rotor 82.

The cylindrical stator 81 has a cylindrical shape, around the axis O, that extends in the axis O direction. The inside surface and the outside surface of the cylindrical stator 81 are parallel to the axis O. The outside surface of the cylindrical stator 81 is fitted to the cylindrical fixing recess portion 56 in the first cavity 50A of the shroud 50. That is, the cylindrical stator 81 is fixed integrally with the shroud 50. The outside diameter of the outside surface of the cylindrical stator 81 is the same as the inside diameter of the bottom surface of the cylindrical fixing recess portion 56 over the axis O direction.

The cylindrical rotor 82 has a cylindrical shape, around the axis O, that extends in the axis O direction. The inside surface and the outside surface of the cylindrical rotor 82 are parallel to the axis O. The outside diameter of the cylindrical rotor 82 is set to be smaller than the inside diameter of the cylindrical stator 81. The dimension of the cylindrical rotor 82 in the axis O direction is the same as that of the cylindrical stator 81. The cylindrical rotor 82 is integrally fixed to the cylindrical fixing surface 32*a* of the first base portion 32 in the outer circumferential ring 30 of the first propeller 10A from the outer circumference side. Therefore, the inside diameter of the cylindrical rotor 82 is the same as the outside diameter of the cylindrical fixing surface 32*a* over the axis O direction.

The outside surface of the cylindrical rotor 82 faces the inside surface of the cylindrical stator 81 over the circumferential direction and the axis O direction. A first clearance C1 is formed between the outside surface of the cylindrical rotor 82 and the inside surface of the cylindrical stator 81 over the circumferential direction and the axis O direction. The first clearance C1 is connected to the first outlet flow path 100 and the first inlet flow path 101. Therefore, the first outlet flow path 100 and the first inlet flow path 101 bring the flow path and the first clearance C1 into communication with each other.

The end surface on the upstream side of the cylindrical rotor 82 is in contact with the first holding portion 34 in the outer circumferential ring 30 of the first propeller 10A from the downstream side. The end surface on the downstream side of the cylindrical rotor 82 is in contact with the second holding portion 35 in the outer circumferential ring 30 of the first propeller 10A from the upstream side.

In such a cylindrical motor 80, energizing the cylindrical stator 81 generates a rotating magnetic field, which rotates the cylindrical rotor 82 around the axis O.

Conical Motor

As illustrated in FIGS. 2 and 3, the conical motor 90 is accommodated in the second cavity 50B in the shroud 50. The conical motor 90 drives the second propeller 10B. The conical motor 90 includes a conical rotor (rotor) 92 and a conical stator (stator) 91.

The conical rotor 92 has a ring shape fixed to the outer circumference side of the outer circumferential ring 30 of the second propeller 10B, and is accommodated in the shroud 50. The conical stator 91 has a ring shape surrounding the rotor via the clearance, and is fixed in the shroud 50.

In the conical motor 90, energizing the coil of the conical stator 91 generates a rotating magnetic field, which rotationally drives the conical rotor 92 around the axis O. The rotation direction of the conical motor 90 is opposite to the rotation direction of the cylindrical motor 80. That is, the rotational directions of the conical motor 90 and the cylindrical motor 80 are opposite to each other.

As illustrated in FIGS. 2 and 3, the conical rotor 92 has the end portion on the upstream side in contact with the first holding portion 34 from the downstream side while being fixed to the second base portion 33 in the outer circumferential ring 30 of the second propeller 10B. The end portion on the downstream side of the conical rotor 92 is in contact with the second holding portion 35 from the upstream side.

The outside surface of the conical rotor 92 faces the inside surface of the conical stator 91 over the circumferential direction and the axis O direction. A second clearance C2 is formed between the outside surface of the conical rotor 92 and the inside surface of the conical stator 91 over the circumferential direction and the axis O direction. The second clearance C2 is connected to the second inlet flow path 102 and the second outlet flow path 103. Therefore, the second inlet flow path 102 and the second outlet flow path 103 bring the flow path and the second clearance C2 into communication with each other.

Operational Effects

With the propulsor 8 driven, the underwater vehicle 1 having the above-described configuration can cruise underwater. That is, when the cylindrical motor 80 in the first cavity 50A of the shroud 50 is driven, the first propeller 10A integrally fixed to the cylindrical rotor 82 of the cylindrical motor 80 rotates around the axis O toward one side in the circumferential direction. As a result, water is pumped to the downstream side by the first blades 20A located in the flow path. Furthermore, when the conical motor 90 is driven simultaneously with the driving of the cylindrical motor 80, the second propeller 10B integrally fixed to the conical rotor 92 of the conical motor 90 rotates around the axis O toward the other side in the circumferential direction. As a result, water is pumped to the downstream side by the second blades 20B located in the flow path.

In addition, as reaction force produced when pumping water, propulsion force toward the upstream side is generated at the first propeller 10A and the second propeller 10B. This propulsion force is transmitted from the inner circumferential rings 11 of the first propeller 10A and the second propeller 10B to the shaft portion 3 via the water film and the upstream thrust bearing 42. Accordingly, the propulsion force acts on the shaft portion 3 and the vehicle main body 2 integrated therewith, whereby the underwater vehicle 1 is propelled.

According to the propulsor 8 in the present embodiment, the second inlet flow path 102 is open at a portion between the first propeller 10A and the second propeller 10B in the flow path-forming surface 55, and the second outlet flow path 103 is open at a portion on the downstream side of and separated from the second propeller 10B in the flow path-forming surface 55. In addition, the flow path cross-sectional area of the flow path becomes smaller at least toward the downstream side of the second propeller 10B. In other words, the static pressure of the fluid in the flow path on the downstream side of the second propeller 10B is lower than the static pressure of the fluid in the flow path between the first propeller 10A and the second propeller 10B. That is, a difference in static pressure between the two flow paths occurs with the second propeller 10B serving as the boundary. As a result, a portion of the fluid flowing from upstream to downstream in the flow path always flows from the flow path between the first propeller 10A and the second propeller 10B to the second inlet flow path 102, the second clearance C2, and the second outlet flow path 103 in this order, and flows out to the flow path on the downstream side of the second propeller 10B. Therefore, since the fluid flowing through the second clearance C2 and the conical motor 90 constantly exchange heat, the conical motor 90 can be stably cooled.

Furthermore, according to the propulsor 8 in the present embodiment, the second outlet flow path 103 is open in the vicinity of the minimum inside diameter position P at which the inside diameter of the flow path-forming surface 55 is minimized in the flow path-forming surface 55. This makes it possible to increase the flow rate of the fluid flowing from the flow path between the first propeller 10A and the second propeller 10B to the flow path on the downstream side of the second propeller 10B, via the second inlet flow path 102, the second clearance C2, and the second outlet flow path 103. Therefore, the conical motor 90 can be more effectively cooled.

Furthermore, according to the propulsor 8 in the present embodiment, the vicinity of the minimum inside diameter position P is a region falling within the range of ±10% of the dimension R of the shroud in the axis direction, based on the minimum inside diameter position P. This makes it possible to realize the above-described operational effects by a specific design value.

Furthermore, according to the propulsor 8 in the present embodiment, together with the shroud inside surface 51 of the shroud 50, the ring inside surface 31 of the outer circumferential ring 30 forms the flow path-forming surface 55. As a result, it is possible to reduce the possibility of fluid separation or the like occurring in the vicinity of the ring inside surface 31. In other words, the pressure loss caused when the fluid passes through the second propeller 10B can be reduced. Therefore, the fluid can be pumped more efficiently to the downstream side of the second propeller 10B.

OTHER EMBODIMENTS

The embodiments of the disclosure have been described above in detail with reference to the drawings. However, specific configurations are not limited to the configurations of the embodiments. Any configuration can be added, omitted, substituted, or otherwise modified, as long as such addition, omission, substitution, or modification does not depart from the scope of the disclosure. Furthermore, the disclosure is not to be considered as being limited by the embodiments but is only limited by the scope of the appended claims.

In the embodiments, a configuration has been described in which the annular flow path formed between the flow path-forming surface 55 and the shaft outside surface 3*a* of the shaft portion 3 is narrowed radially inward from the shroud leading edge 53 toward the minimum inside diameter position P. However, the disclosure is not limited thereto. For example, a configuration may be adopted in which the portion on the upstream side of the second propeller 10B in the flow path-forming surface 55 has a uniform radial dimension in the axis O direction, and only a portion on the downstream side of the second propeller 10B decreases in diameter toward the downstream side.

Further, in the embodiments, an example has been described in which, of the two propellers of the first propeller 10A and the second propeller 10B, only the motor that drives the second propeller 10B is the conical motor 90. However, the disclosure is not limited thereto. That is, it is only required that the same number of motors as the number of propellers are provided so as to correspond to a plurality of propellers. Each of these motors may be any of a cylindrical type and a conical type.

Further, in the embodiments, an example has been described in which the cross-sectional shape of the shroud 50 is a blade shape, but it need not be a blade shape. The cross-sectional shape of the shroud 50 is preferably a streamlined shape, but may be other shapes such as a rectangular shape, for example. Even in this case, the shroud inside surface 51 forming the flow path-forming surface 55 decreases in diameter toward the downstream side, whereby a flow path is defined and formed of which the flow path cross-sectional area becomes smaller toward the downstream side.

Furthermore, for the shape of the shroud 50, it is only required that the shroud inside surface 51 decreases in diameter toward the downstream side. That is, the shape of the shroud outside surface 52 need not decrease in diameter toward the downstream side.

Further, in the embodiments, an example has been described in which the fluid machine according to the disclosure is applied to the propulsor 8 of the underwater vehicle 1. However, the disclosure is not limited thereto. For example, the fluid machine may be applied to propulsors of marine vessels or the like that cruise on water.

Furthermore, the fluid machine according to the disclosure may be applied not only to propulsors but also to other fluid machines used underwater such as pumps. Furthermore, the disclosure may be applied not only to fluid machines that pump water, but also to fluid machines that pump other types of liquid such as oil.

Supplementary Notes

The propulsor (fluid machines) described in each of the embodiments are grasped as follows, for example.

(1) A fluid machine according to a first aspect includes: a shaft portion 3 extending in an axis O direction; a shroud 50 provided so as to surround the shaft portion 3 and including a shroud inside surface 51 that forms a flow path-forming surface 55 defining a flow path through which fluid is flowable in the axis O direction with the shaft portion 3; a first propeller 10A rotatably provided around the axis O in the flow path; a second propeller 10B rotatably provided around the axis O on a downstream side of the first propeller 10A in the flow path; and a motor including a rotor that has a ring shape fixed to an outer circumferential portion of the second propeller 10B and that is accommodated in the shroud 50 and a stator that has a ring shape surrounding the rotor via a clearance and that is fixed in the shroud 50, wherein at least a portion of the flow path-forming surface 55 on a downstream side of the second propeller 10B decreases in diameter toward the downstream side, and the shroud 50 includes an inlet flow path that is open at a portion between the first propeller 10A and the second propeller 10B in the flow path-forming surface 55 and that brings the flow path and the clearance into communication with each other and an outlet flow path that is open at a portion on the downstream side of and separated from the second propeller 10B in the flow path-forming surface 55 and that brings the flow path and the clearance into communication with each other.

According to the above-described configuration, the flow path cross-sectional area of the flow path becomes smaller at least toward the downstream side of the second propeller 10B. In other words, the static pressure of the fluid in the flow path on the downstream side of the second propeller 10B is lower than the static pressure of the fluid in the flow path between the first propeller 10A and the second propeller 10B. That is, a difference in static pressure between the two flow paths occurs with the second propeller 10B serving as the boundary. As a result, a portion of the fluid flowing from upstream to downstream in the flow path always flows from the flow path between the first propeller 10A and the second propeller 10B to the inlet flow path, the clearance, and the outlet flow path in this order, and flows out to the flow path on the downstream side of the second propeller 10B. Therefore, the fluid flowing through the clearance and the motor can constantly exchange heat.

(2) The fluid machine according to a second aspect is the fluid machine of (1), wherein the outlet flow path may be open in the vicinity of the minimum inside diameter position P at which the inside diameter of the flow path-forming surface 55 is minimized in the flow path-forming surface 55.

According to the above-described configuration, it is possible to increase the flow rate of the fluid flowing from the flow path between the first propeller 10A and the second propeller 10B to the flow path on the downstream side of the second propeller 10B via the inlet flow path, the clearance, and the outlet flow path.

(3) The fluid machine according to a third aspect is the fluid machine of (2), wherein the vicinity of the minimum inside diameter position P may be a region falling within a range ±10% of a dimension R of the shroud in the axis direction, based on the minimum inside diameter position P.

According to the above-described configuration, it is possible to realize the above-described operational effects by a more specific design value.

(4) The fluid machine according to a fourth aspect is the fluid machine of any of (1) to (3), wherein the second propeller 10B includes a plurality of blades that radially extend in the flow path and that are disposed spaced apart in a circumferential direction and an outer circumferential ring 30 that has a ring-shape, that is accommodated in a cavity recessed from the shroud inside surface 51, and that connects the plurality of blades in the circumferential direction, the outer circumferential ring 30 includes a ring inside surface 31 that faces radially inward and that forms the flow path-forming surface 55 with the inside surface of the shroud 50, the inlet flow path is defined and formed by an end surface on an upstream side of the outer circumferential ring 30 and an inner surface of the cavity, and the outlet flow path is defined and formed by an end surface on a downstream side of the outer circumferential ring 30 and an inner surface of the cavity.

According to the above-described configuration, it is possible to reduce the possibility of fluid separation or the like occurring in the vicinity of the ring inside surface 31. In other words, the pressure loss caused when the fluid passes through the second propeller 10B can be reduced.

While preferred embodiments of the invention have been described as above, it is to be understood that variations and modifications will be apparent to those skilled in the art without departing from the scope and spirit of the invention. The scope of the invention, therefore, is to be determined solely by the following claims.

The invention claimed is:

1. A fluid machine comprising:

a shaft portion extending in an axis direction;

a shroud provided so as to surround the shaft portion and including a shroud inside surface that forms a flow path-forming surface defining an annular flow path through which fluid is flowable in the axis direction, the flow path being defined between the flow path-forming surface and the shaft portion;

a first propeller rotatably provided around the axis in the flow path;

a second propeller rotatably provided around the axis on a downstream side of the first propeller in the flow path; and a motor including a rotor that has a ring shape fixed to an outer circumferential portion of the second propeller and that is accommodated in the shroud, and a stator that has a ring shape surrounding the rotor via a clearance and that is fixed in the shroud, wherein the shroud includes an inlet flow path that is open at a portion between the first propeller and the second propeller in the flow path-forming surface and that brings the flow path and the clearance into communication with each other, and an outlet flow path that is open at a portion on a downstream side of and separated from the second propeller in the flow path-forming surface and that brings the flow path and the clearance into communication with each other, and wherein at least a portion of the flow path-forming surface on the downstream side of the second propeller decreases in diameter toward the downstream side such that a cross-sectional area of the flow path on the downstream side of the second propeller decreases toward the downstream side, whereby a static pressure in the outlet flow path is less than a static pressure in the inlet flow path.

2. The fluid machine according to claim 1, wherein the outlet flow path is open in a vicinity of a minimum inside diameter position at which an inside diameter of the flow path-forming surface is minimized in the flow path-forming surface.

3. The fluid machine according to claim 2, wherein the vicinity of the minimum inside diameter position is a region falling within a range of ±10% of a dimension of the shroud in the axis direction, based on the minimum inside diameter position.

4. The fluid machine according to claim 1, wherein the second propeller includes a plurality of blades that radially extend in the flow path and that are disposed spaced apart in a circumferential direction, and an outer circumferential ring that has a ring-shape, that is accommodated in a cavity recessed from the shroud inside surface, and that connects the plurality of blades in the circumferential direction, wherein the outer circumferential ring includes a ring inside surface that faces radially inward and that forms the flow path-forming surface together with the shroud inside surface, the inlet flow path is defined and formed by an upstream-side end surface of the outer circumferential ring and a first inner surface of the cavity, and the outlet flow path is defined and formed by a downstream-side end surface of the outer circumferential ring and a second inner surface of the cavity.

* * * * *